US006291942B1

(12) United States Patent
Odagiri et al.

(10) Patent No.: US 6,291,942 B1
(45) Date of Patent: Sep. 18, 2001

(54) SELF-LUMINOUS DISPLAY ELEMENT DRIVING DEVICE

(75) Inventors: Hiroshi Odagiri; Kazumi Sakumoto; Masafumi Hoshino; Susumu Fujita; Tokuya Akase, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/602,757

(22) Filed: Jun. 23, 2000

(30) Foreign Application Priority Data

Jun. 28, 1999 (JP) ..... 11-181787

(51) Int. Cl.[7] ..... G09G 3/10

(52) U.S. Cl. ..... 315/169.3; 315/307; 345/45; 345/77; 345/90

(58) Field of Search ..... 315/169.3, 291, 315/307, 209 R; 345/76, 77, 45, 80, 90

(56) References Cited

U.S. PATENT DOCUMENTS 5,982,104 * 11/1999 Sasaki et al. ..... 315/169.3
6,091,382 * 7/2000 Shioya et al. ..... 345/76
6,229,505 * 5/2001 Fujii ..... 345/76

* cited by examiner

*Primary Examiner*—Haissa Philogene
(74) *Attorney, Agent, or Firm*—Adams & Wilks

(57) ABSTRACT

There is provided a self-luminous display element driving device which prevents the luminance of a self-luminous display element from changing with the elapse of time and reduces the cost. In the device for constant-voltage driving the self-luminous display element by continuously making on and off states of application of a constant voltage to the self-luminous display element, the self-luminous display element driving device includes a circuit for generating deterioration information concerning a deterioration state of the self-luminous display element, and a circuit for adjusting a time width in which the constant voltage is applied to the self-luminous display element or a time width in which the constant voltage is not applied, on the basis of the deterioration information generated by the deterioration information generating circuit. The self-luminous display element may be, for example, an EL (electroluminescence) element or an organic EL element.

15 Claims, 10 Drawing Sheets

SELF-LUMINOUS DISPLAY ELEMENT DRIVING DEVICE

BACKGROUND OF THE INVENTION

1. Field of the Invention

The present invention relates to a driving device for driving a self-luminous display, such as an EL (electroluminescence) element or an organic EL element, and more particularly to a driving device for constant-voltage driving a self-luminous display element by continuously making on and off states of application of a constant voltage to the self-luminous display element.

2. Description of the Related Art

In recent years, as a self-luminous display, an EL (electroluminescence) element or an organic EL element has been put to practical use. Especially the organic EL element realizes high luminance light emission and high efficiency, it is driven with a DC low voltage, and it has a high speed response. Therefore it is ideal as a light emitting type display. Such a self-luminous display element has a feature that its light emission luminance is in proportion to current density as shown in FIG. 8, and a feature that its V-I characteristics are changed with the elapse of time as shown in FIGS. 9 and 10, that is, it is deteriorated with time so that a current made to flow to obtain luminance of a constant value is changed. As a driving method of the self-luminous display element, there are two kinds of methods, constant-current driving and constant-voltage driving.

As a conventional driving device for driving the self-luminous display element, there is circuit for making constant-current driving. In the case where the self-luminous display element is divided into a plurality of segments or dots, this constant-current driving circuit is provided for the respective dots or segments on a one-to-one basis, and drives the respective segments or dots. According to the constant-current driving circuit, since a constant current is supplied to the self-luminous display element, even if the self-luminous display element is deteriorated and the V-l characteristics are changed, a supplied current is not changed nor the luminance is not changed.

However, since this conventional constant-current driving circuit must be provided for each dot or segment on a one-to-one basis, there has been disadvantages that its device becomes large or complicated, and the cost is increased. Particularly, in the case where the areas of the respective segments are different from each other, since different constant-current driving circuits designed to correspond to the respective areas must be prepared, there has been a disadvantage that its device becomes further complicated and the cost is increased.

As a conventional self-luminous display element driving device for solving the foregoing disadvantages, there is a circuit for making constant-voltage driving. With respect to this constant-voltage driving circuit, only one circuit is provided for a plurality of dots or segments, and applies a constant voltage to the plurality of dots or segments at a constant duty cycle. According to this constant-voltage driving circuit, since only one constant-voltage driving circuit is to be provided for the plurality of dots or segments, its device can be made simple or small, and the cost can be reduced.

However, according to the foregoing conventional constant-voltage driving circuit, since a constant voltage is applied to a self-luminous display element at a constant duty cycle, there has been a problem that in the case where the V-l characteristics of the self-luminous display element is changed with the elapse of time, current flowing to the self-luminous display element is changed by this and the luminance of the self-luminous display element is changed, so that suitable luminance can not be obtained.

SUMMARY OF THE INVENTION

The present invention has been made in view of the above, and an object of the invention is to prevent the luminance of a self-luminous display element from changing with the elapse of time and to reduce the cost.

In order to achieve the above object, according to the present invention, in a driving device for constant-voltage driving a self-luminous display element by continuously making on and off states of application of a constant voltage to the self-luminous display element, the self-luminous display element driving device includes means for generating deterioration information concerning a deterioration state of the self-luminous display element so that a duty cycle of voltage, in other words, an on and off ratio of voltage application is changed in accordance with the deterioration state of the self-luminous display element, and means for adjusting, on the basis of the deterioration information generated by the generation means, a time width in which the constant voltage is applied to the self-luminous display element or a time width in which the constant voltage is not applied. That is, the adjustment means increases or decreases the time width in which the constant voltage is applied or the time width in which the constant voltage is not applied, so that the brightness of the self-luminous display element is not changed.

Here, the generation means may measure a time to generate the deterioration information on the basis of an elapsed time, or may detect the luminance of a part or all of the self-luminous display element to generate the deterioration information on the basis of the luminance. Besides, the generation means may detect a current flowing to a part or all of the self-luminous display element to generate the deterioration information on the basis of a current value, or may include means for constant-current driving a part or all of the self-luminous display element and detect a voltage drop by the self-luminous display element, which is constant-current driven by the means, to generate the deterioration information on the basis of a voltage value. Further, the self-luminous display element may be an electroluminescence element or an organic electroluminescence element.

DETAILED DESCRIPTION OF THE PREFERRED EMBODIMENTS

Preferred embodiments of the present invention will be described with reference to the accompanying drawings in order of embodiment 1 to embodiment 4.

EMBODIMENT 1

As a self-luminous display element driving device of embodiment 1, for example, in the case where an organic EL (electroluminescence) element is applied for 7 segments forming a figure of 8 for numerical display of an electronic wrist watch, a self-luminous display element driving circuit for driving this organic EL element will be cited as an example. Incidentally, in the embodiment 1, although the electronic wrist watch is cited as an example, the invention is not limited to this example, but may be applied to other electronic watches or various instruments using self-luminous display elements. Besides, instead of the segment display, other display methods, for example, dot matrix display may be used. Further, instead of the organic EL, other self-luminous display elements, for example, AC driven EL may be used.

Figure 1:
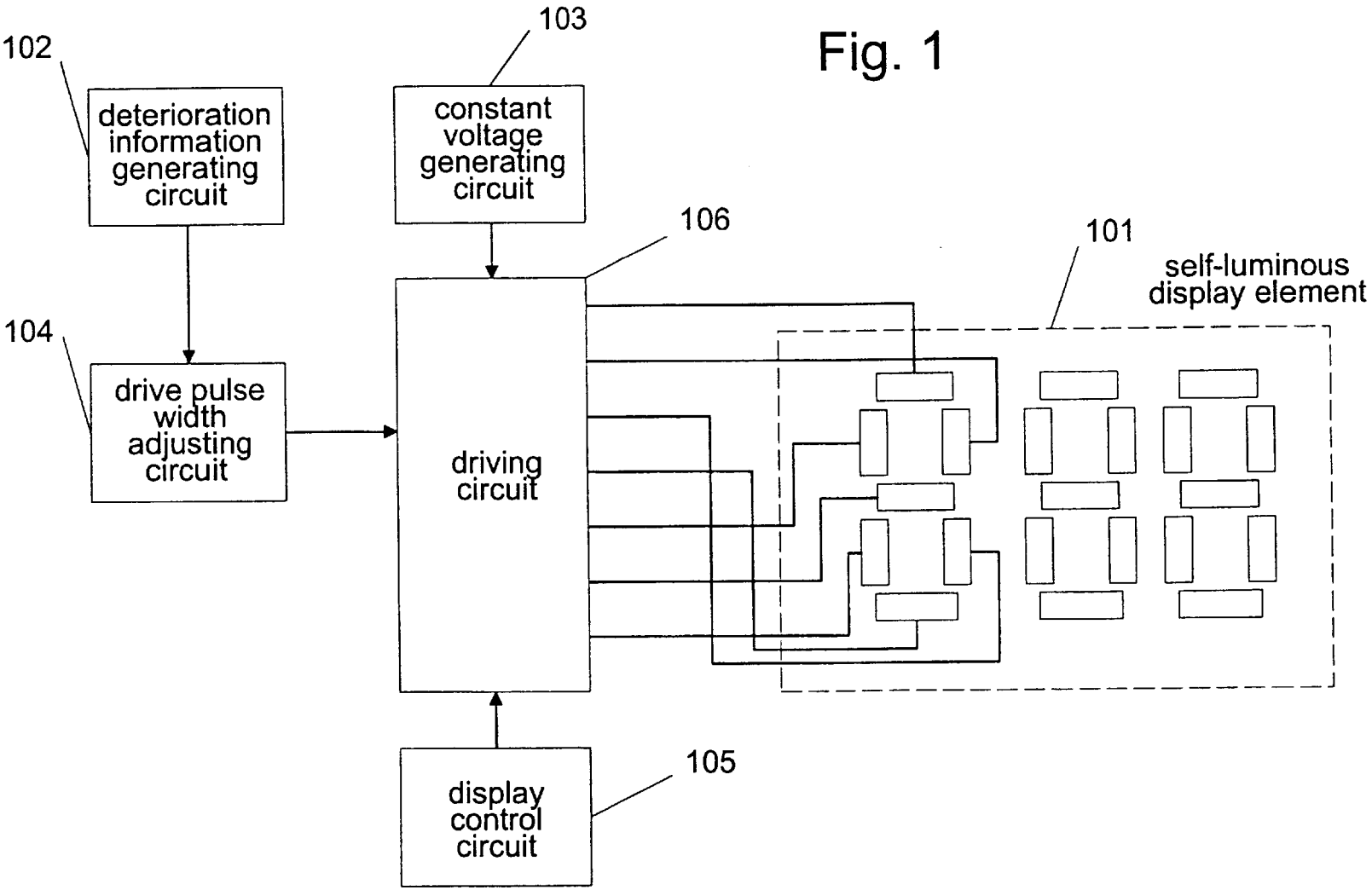
FIG. 1 is a view showing a schematic structure of a self-luminous display element driving circuit according to embodiment 1 of the present invention.

FIG. 1 is a view showing a schematic structure of a self-luminous display element driving circuit according to the embodiment 1 of the present invention. The self-luminous display element driving circuit of the embodiment 1 includes a circuit 102 for generating deterioration information concerning a deterioration state of a self-luminous display element 101, a circuit 103 for generating a driving voltage of the self-luminous display element 101, a circuit 104 for adjusting a time width in which a constant voltage is applied to the self-luminous display element 101 and a time width in which the constant voltage is not applied, that is, for adjusting an on and off ratio (duty cycle) of voltage application, on the basis of the deterioration information from the deterioration information generating circuit 102, a circuit 105 for controlling on and off states of voltage application to respective segments (display elements) of the self-luminous display element 101 in accordance with a figure to be displayed, and a driving circuit 106 for making the on and off states of voltage application to the respective segments of the self-luminous display element 101.

The deterioration information generating circuit 102 uses clocking information from the electronic watch or a clock signal from another circuit to measure an elapsed time from the manufacture of the self-luminous display element 101 or from some point of time after the manufacture, and generates deterioration information on the basis of the elapsed time, for example, "1" until 10000 hours, and "2" from 10000 hours to 20000 hours. The display control circuit 105 outputs lighting/non-lighting information for controlling the on and off states of voltage application, and the driving circuit 106 applies the driving voltage generated in the constant voltage generating circuit 103 to the respective segments of the self-luminous display element 101 on the basis of the lighting/non-lighting information from the display control circuit 105. By this, the appointed segments emit light and the figure is displayed.

The drive pulse width adjusting circuit 104 outputs control pulses for continuously controlling on and off states of application of the constant voltage to the self-luminous display element 101, and the driving circuit 106 makes the on and off states of voltage application to the respective segments of the self-luminous display element 101 on the basis of the control pulses output from the drive pulse width adjusting circuit 104. That is, dynamic driving is performed. By this, the self-luminous display element 101 repeats the on and off states. Here, since the on and off states are repeated at an interval shorter than an afterimage time of a human eye, a person sees the self-luminous display element 101 as if it remains turned on. As the ratio of an on time width to an off time width becomes larger, the display element becomes brighter.

Figure 2:
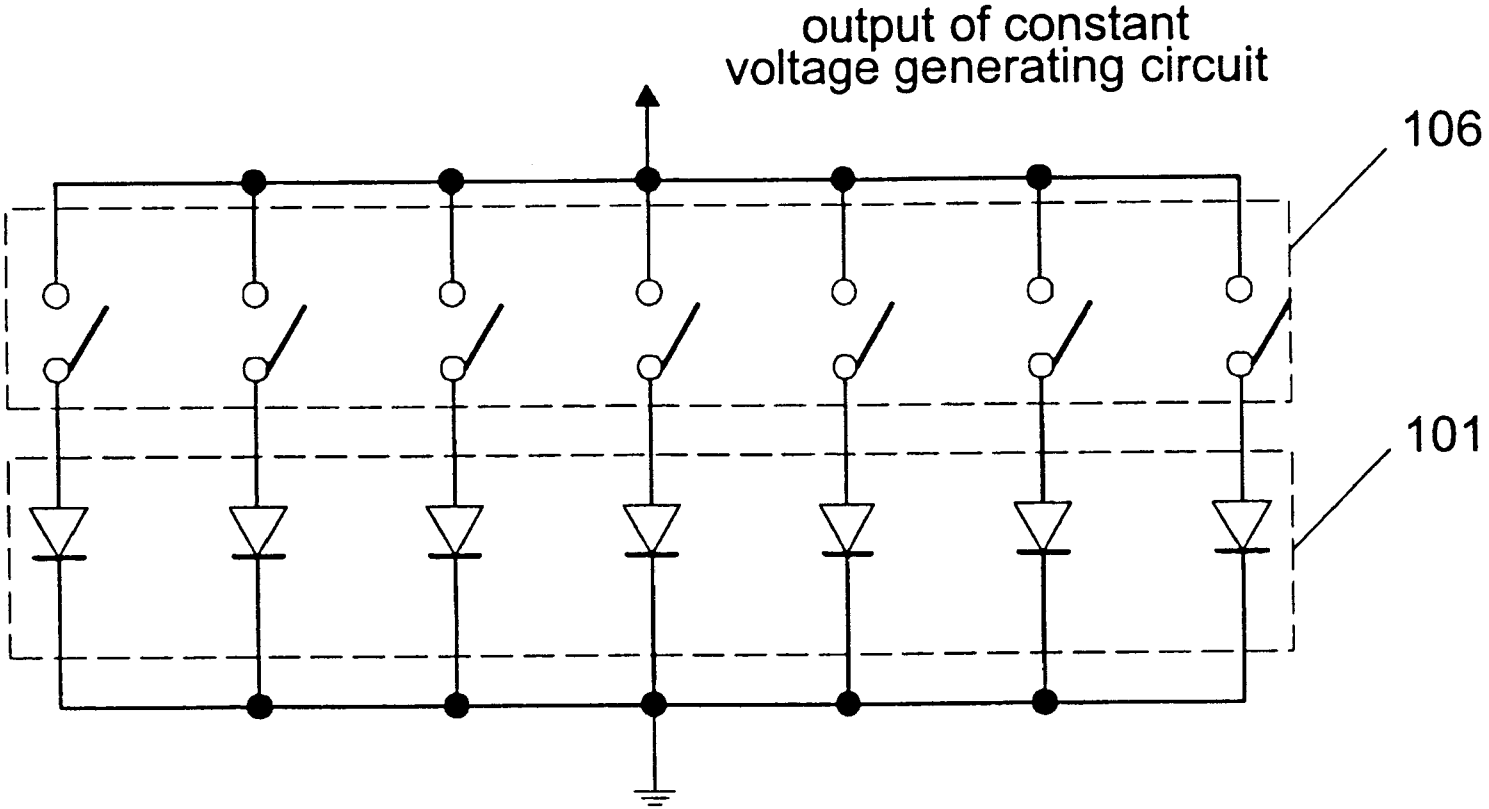
FIG. 2 is a view showing a schematic structure of a driving circuit and a self-luminous display element shown in FIG. 1.

FIG. 2 is a view showing a schematic structure of the driving circuit 106 and the self-luminous display element 101 shown in FIG. 1. As shown in the drawing, the driving circuit 106 is constituted by switches respectively corresponding to each segment of the self-luminous display element 101, and pairs each including the segment of the self-luminous display element 101 and the switch of the driving circuit 106 are provided in parallel with each other. In this structure, when one of the switches of the driving circuit 106 is switched on, the corresponding segment of the self-luminous display element 101 becomes bright. On the other hand, when one of the switches of the driving circuit 106 is switched off, the corresponding segment of the self-luminous display element 101 becomes dark. Incidentally, in this embodiment, although one switch is provided for one segment, a plurality of switches, for example, a switch for a display control circuit and a switch for a drive pulse width adjusting circuit may be provided for one segment.

Figure 3:
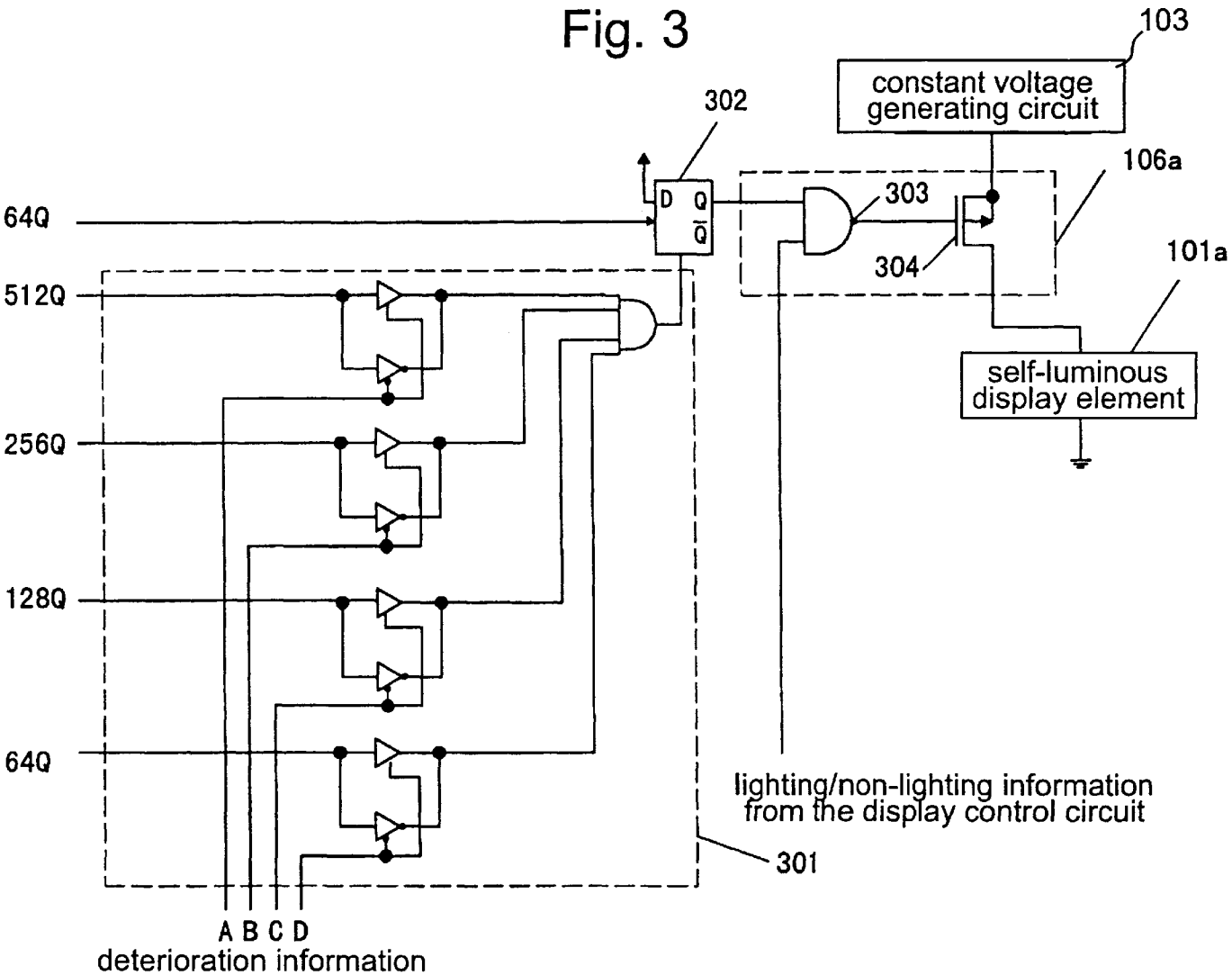
FIG. 3 is a view showing a schematic structure of a drive pulse width adjusting circuit shown in FIG. 1.

FIG. 3 is a view showing a schematic structure of the drive pulse width adjusting circuit 104 shown in FIG. 1. The drive pulse width adjusting circuit 104 includes a multiplexer 301 for converting parallel deterioration information from the deterioration information generating circuit 102 into a serial signal, and a flip-flop 302 for outputting a control pulse to the respective switches of the driving circuit 106 on the basis of a clock input 64Q and a reset input from the multiplexer 301. An arbitrary switch 106*a* of the driving circuit 106 includes a p-channel transistor 304 for making on and off states of voltage application to a corresponding segment 101a of the self-luminous display element 101, and a NAND circuit 303 for turning on and off the p-channel transistor 304 by receiving the control pulse from the flip-flop 302 and the lighting/non-lighting information from the display control circuit 105.

The multiplexer 301, for example, receives frequency-divided signals 512Q, 256Q, 128Q and 64Q obtained by frequency-dividing a reference signal, and converts parallel deterioration information A, B, C and D of 4 bits into a serial signal. The serial signal becomes a signal for adjusting the duty cycle, and the flip-flop 302 outputs a control pulse corresponding to the serial signal to each switch of the driving circuit 106.

In the case where the lighting/non-lighting information from the display control circuit 105 indicates an instruction of lighting, the arbitrary switch 106*a* turns on and off the p-channel transistor 304 in accordance with the control pulse reflecting the deterioration information from the flip-flop 302. In accordance with the on and off operations of the p-channel transistor 304, voltage application to the segment 101*a* is made on and off, and the segment 101*a* repeats lighting and extinction. Incidentally, the deterioration information may be any information, and the data length may be any length, such as 3 bits or 5 bits, as well as 4 bits.

Figure 4:
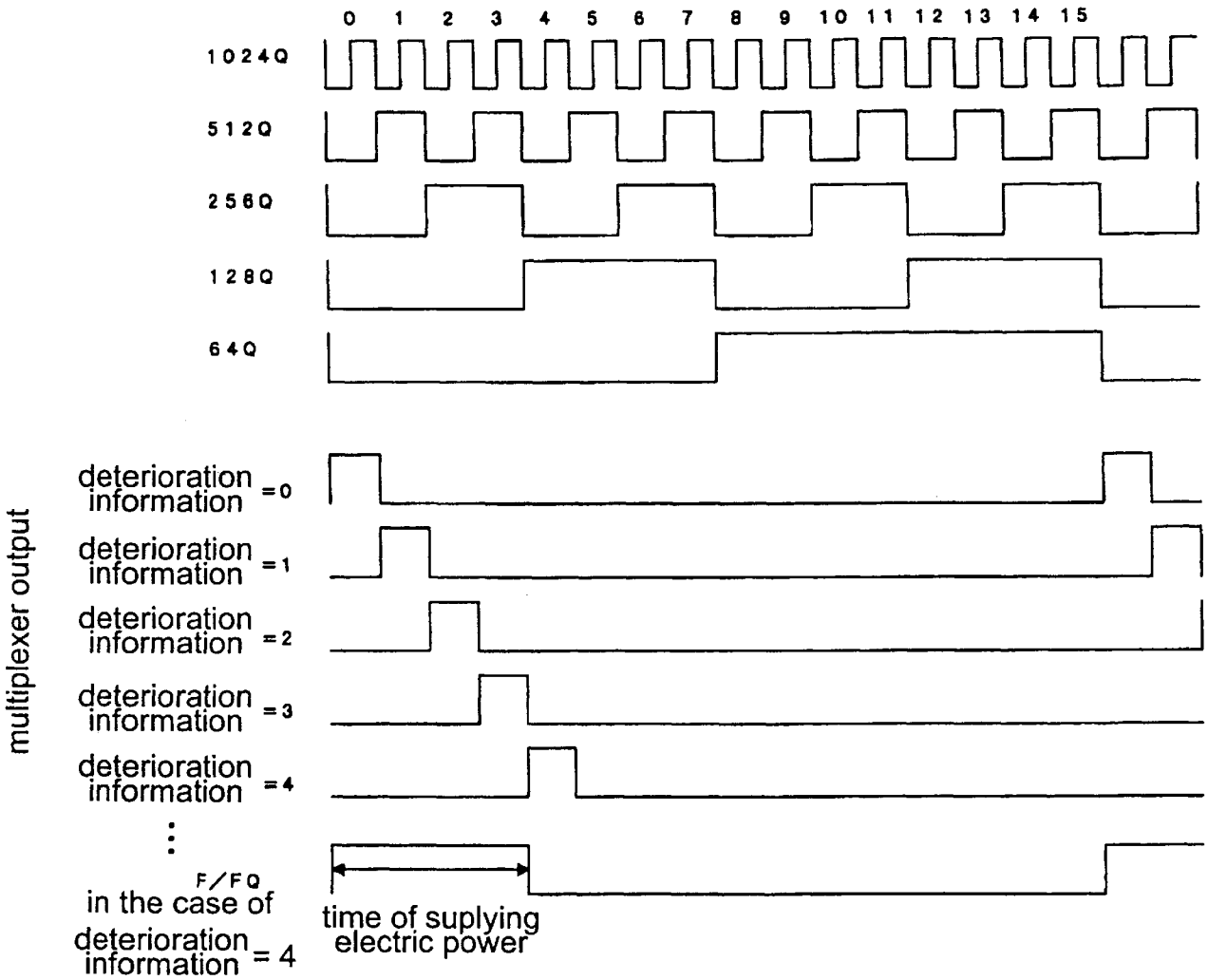
FIG. 4 is a timing chart showing the operation of the drive pulse width adjusting circuit shown in FIG. 3.

In the above structure, the operation of the embodiment 1 will be described with reference to FIG. 4. FIG. 4 is a timing chart showing the operation of the drive pulse width adjusting circuit 104 shown in FIG. 3. In the operation of the drive pulse width adjusting circuit 104, first, the deterioration information A, B, C and D corresponding to an elapsed time is inputted from the deterioration information generating circuit 102, and a serial signal is outputted by using the frequency-divided signals 512Q, 2560, 128Q and 64Q obtained by frequency-dividing the reference signal 1024Q.

For example, in case where A is a lower bit and D is an upper bit, if the deterioration information is 0, that is, if all of A to D are low, a pulse of the serial signal starts to rise immediately after the frequency-divided signal 64Q starts to fall, with all the frequency-divided signals 512Q to 64Q low. In the case where the deterioration information is 1, that is, in the case where A is high and B to D are low, when the frequency-divided signal 512Q is high and the frequency-divided signals 256Q to 64Q become low, that is, after one period of the reference signal 1024Q has elapsed from the falling of the frequency-divided signal 64Q, a pulse of the serial signal starts to rise. Subsequently, in the same way, as the value of the deterioration information is increased, a pulse of the serial signal is shifted by one period of the reference signal 1024Q.

The control pulse (F/FQ in the drawing) as the output signal of the flip-flop 302 rises at the same time as falling of the frequency-divided signal 64Q inputted as a clock, and falls at the same time as rising of the serial signal inputted as a reset. Incidentally, the drawing shows an example of a case where the deterioration information is 4. Like this, the width of the control pulse is adjusted on the basis of the deterioration information. In other words, a time width in which a constant voltage is applied to the self-luminous display element 101 and a time width in which the constant voltage is not applied are adjusted. By this, irrespective of the change of the V-l characteristics of the self-luminous display element 101 with the elapse of time, the luminance of the self-luminous display element 101 can be kept constant.

As described above, according to the embodiment 1, since constant-voltage driving is performed, and only one constant-voltage generating circuit is provided for the plurality of segments, as compared with the case of performing constant-current driving in which one constant-current generating circuit must be provided for each segment, the structure of its device can be made simple or small, and the cost can be reduced. Besides, since the time is measured to generate the deterioration information on the basis of the time, and the duty cycle of applied voltage to the self-luminous display element is adjusted on the basis of the deterioration information, it is possible to prevent the luminance of the self-luminous display element from changing with the elapse of time, which has been a problem in the constant-voltage driving. Especially in the case where the deterioration information generating circuit uses a clock signal from the electronic watch or other circuits, since it is not necessary to prepare a clock signal generating circuit for the deterioration information generating circuit, the cost can be further reduced.

EMBODIMENT 2

A self-luminous display element driving circuit of embodiment 2 has a similar structure to the self-luminous display element driving circuit of the embodiment 1, and its operation is also similar thereto. However, a circuit for generating deterioration information on the basis of luminance is provided instead of the circuit 102 for generating the deterioration information on the basis of time. Hereinafter, the deterioration information generating circuit as a portion different from the embodiment 1 will be described with reference to FIG. 5.

Figure 5:
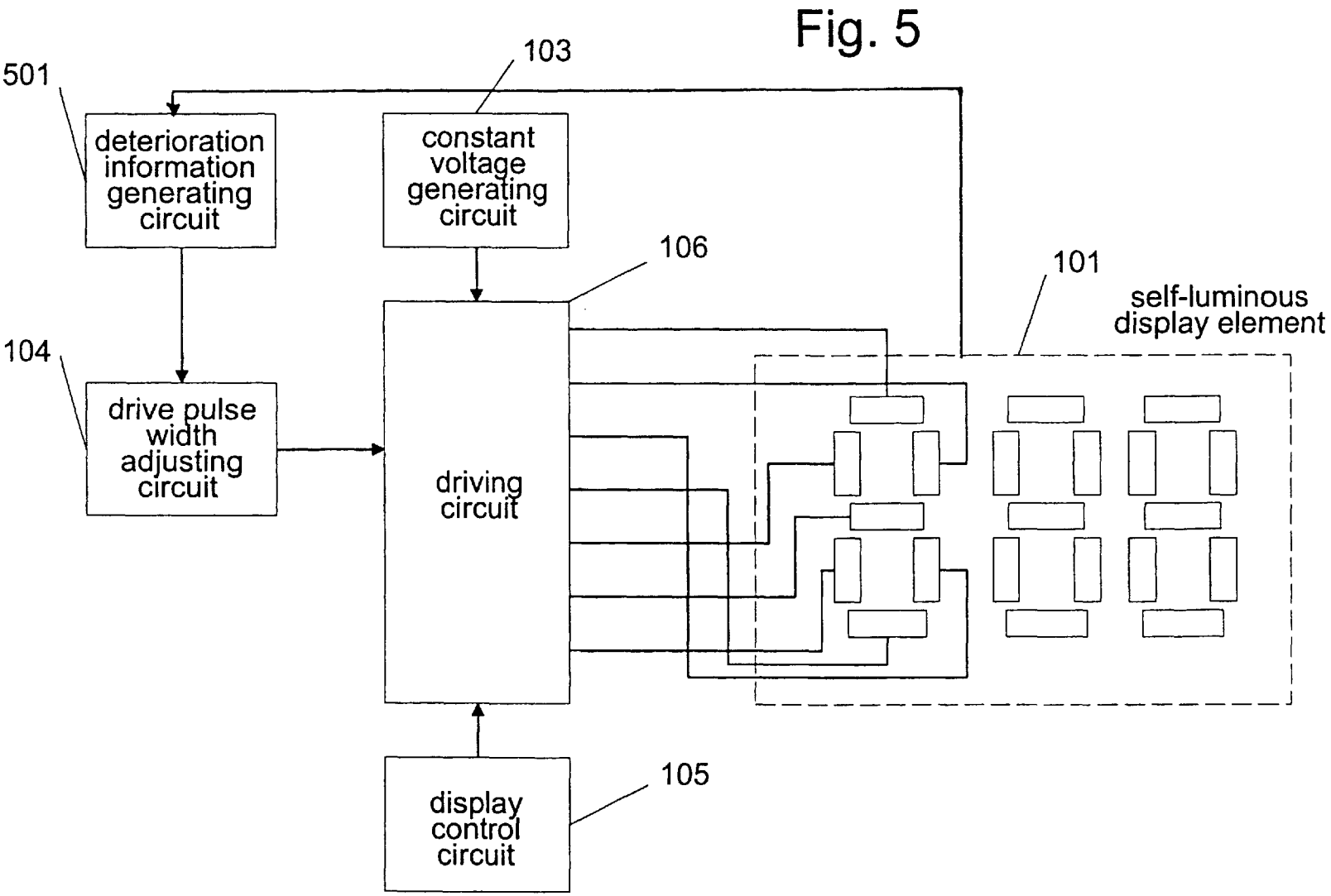
FIG. 5 is a view showing a schematic structure of a self-luminous display element driving circuit according to embodiment 2 of the present invention.

FIG. 5 is a view showing a schematic structure of the self-luminous display element driving circuit according to the embodiment 2 of the present invention. The same parts as those of FIG. 1 are designated by the same symbols and their description is omitted. In the self-luminous display element driving circuit of the embodiment 2, a deterioration information generating circuit 501 is provided instead of the deterioration information generating circuit 102 shown in FIG. 1. The deterioration information generating circuit 501 includes a not-shown optical sensor, detects the luminance of the self-luminous display element 101, and generates deterioration information on the basis of the luminance. With respect to the optical sensor, one sensor may be provided near one segment, or a plurality of sensors may be provided near a plurality of segments. Incidentally, since the optical sensor is a conventional technique well known to one skilled in the art, the description is omitted.

In the above structure, the operation of the embodiment 2 will be described. In accordance with a detection signal from the not-shown optical sensor, the circuit 501 generates deterioration information on the basis of luminance, for example, by adding "1" to deterioration information in the case where a luminance of 20 candela per square meter is lowered, and outputs it to the drive pulse width adjusting circuit 104. That is, the deterioration information generating circuit 501 directly detects the luminance of the self-luminous display element 101 and adjusts on and off time widths of the self-luminous display element 101.

According to the foregoing embodiment 2, since the luminance of the self-luminous display element is directly detected and is adjusted, the brightness of the self-luminous display element can be adjusted more accurately.

EMBODIMENT 3

A self-luminous display element driving circuit of embodiment 3 has a similar structure to the self-luminous display element driving circuit of the embodiment 1 and its operation is also similar thereto. However, a circuit for generating deterioration information on the basis of current flowing through the self-luminous display element 101 is provided instead of the circuit 102 for generating deterioration information on the basis of time. Hereinafter, the deterioration information generating circuit as a portion different from the embodiment 1 will be described with reference to FIG. 6.

Figure 6:
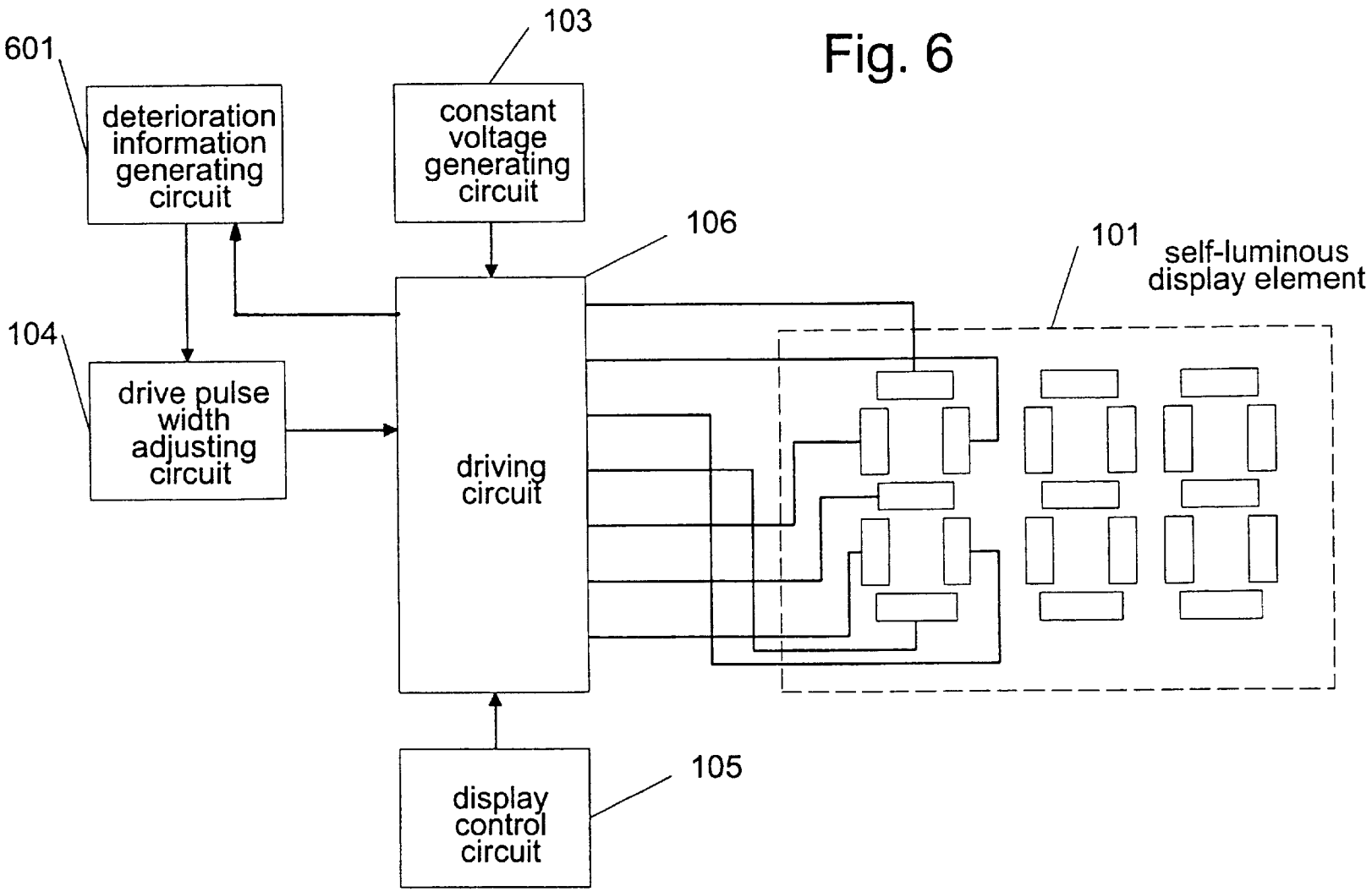
FIG. 6 is a view showing a schematic structure of a self-luminous display element driving circuit according to embodiment 3 of the present invention.

FIG. 6 is a view showing a schematic structure of the self-luminous display element driving circuit according to the embodiment 3 of the present invention. Incidentally, the same portions as those of FIG. 1 are designated by the same symbols and their description is omitted. In the self-luminous display element driving circuit of the embodiment 3, a deterioration information generating circuit 601 is provided instead of the deterioration information generating circuit 102 shown in FIG. 1. The deterioration information generating circuit 601 includes a not-shown current detecting circuit, detects a current flowing through the whole of the self-luminous display element 101 or its partial segments, and generates deterioration information on the basis of the current. The current detecting circuit may be provided at a current passage of one segment or may be provided at a current passage of the whole of the self-luminous display element 101. Incidentally, since the current detecting circuit is a conventional technique well known to one skilled in the art, the description is omitted.

In the above structure, the operation of the embodiment 3 will be described. In accordance with a detection signal from the not-shown current detecting circuit, the circuit 601 generates deterioration information, for example, "1" in the case where a current of 10 mA flows, or "2" in the case where a current of 11 mA flows, and outputs it to the drive pulse width adjusting circuit 104. That is, the deterioration information generating circuit 601 directly detects the current in proportion to the luminance of the self-luminous display element 101 and adjusts on and off time widths of the self-luminous display element 101.

According to the foregoing embodiment 3, since the current in proportion to the luminance of the self-luminous display element is directly detected to adjust a time width in which a constant voltage is applied to the self-luminous display element and a time width in which the constant voltage is not applied, the brightness of the self-luminous display element can be adjusted more accurately.

EMBODIMENT 4

A self-luminous display element driving circuit of embodiment 4 has a similar structure to the self-luminous display element driving circuit of the embodiment 1 and its operation is also similar thereto. However, a circuit for generating deterioration information on the basis of voltage drop caused by the self-luminous display element 101 is provided instead of the circuit 102 for generating the deterioration information on the basis of time. Hereinafter, the deterioration information generating circuit as a portion different from the embodiment 1 will be described with reference to FIG. 7.

Figure 7:
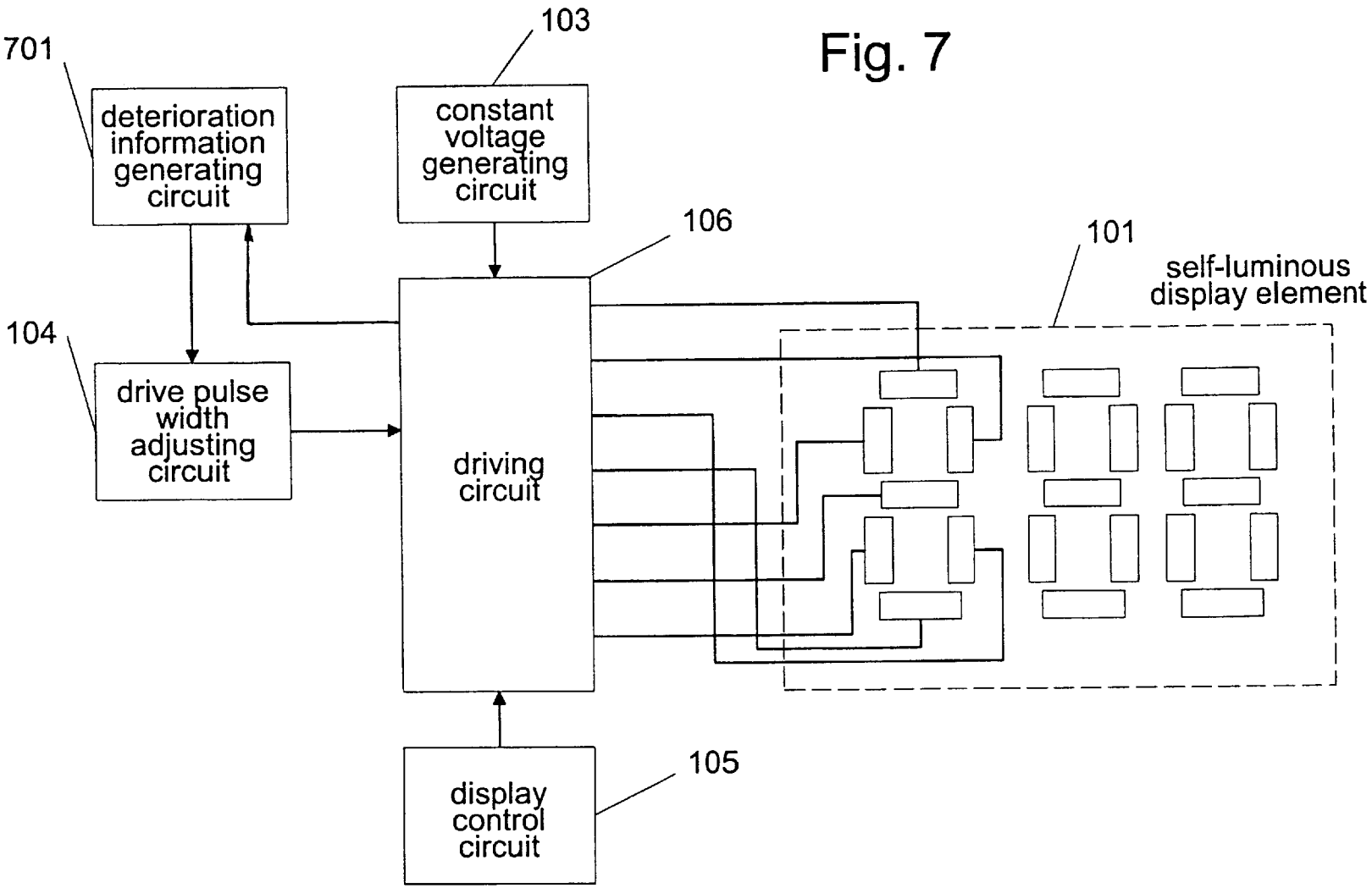
FIG. 7 is a view showing a schematic structure of a self-luminous display element driving circuit according to embodiment 4 of the present invention.
Figure 8:
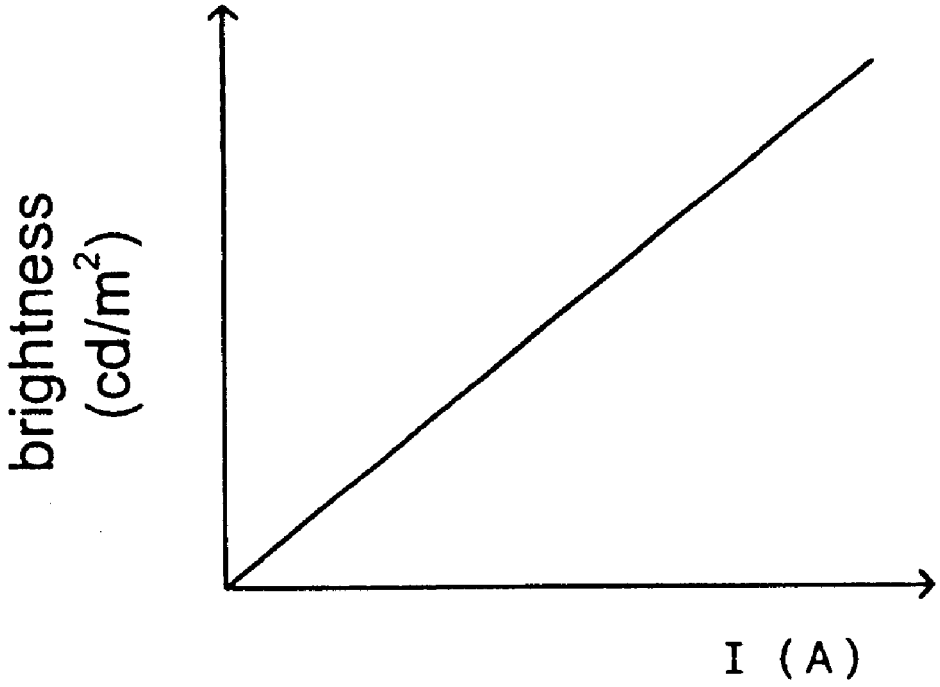
Fig. 8 prior art
FIG. 8 is a view showing the relation between the driving current and the luminance of a conventional self-luminous display element.
Figure 9:
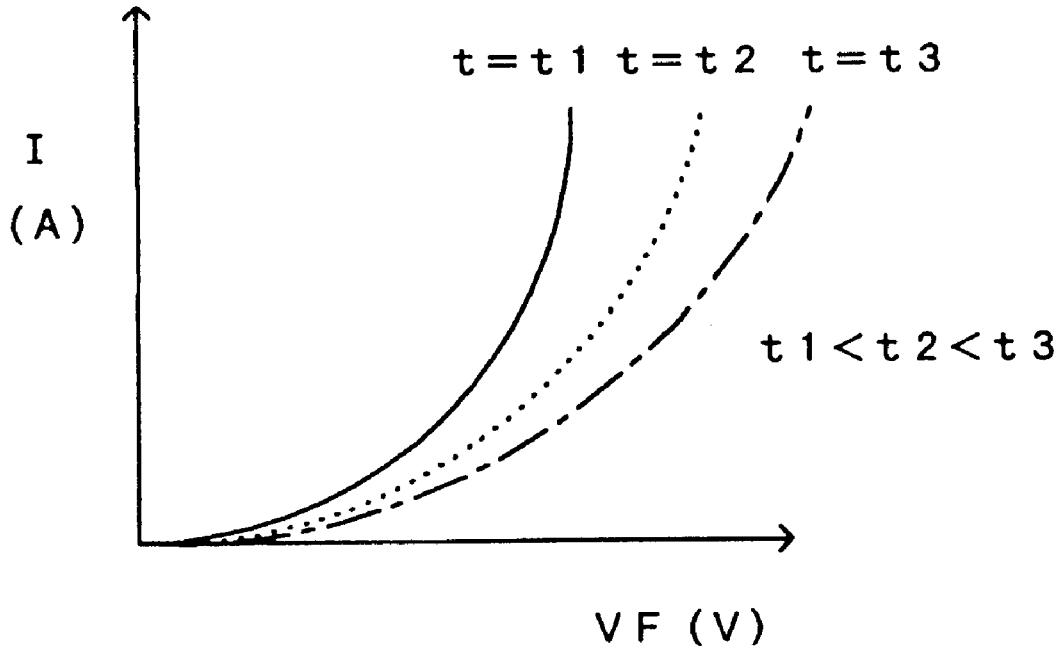
FIG. 9 is a view showing the V-l characteristics of the conventional self-luminous display element.
Figure 10:
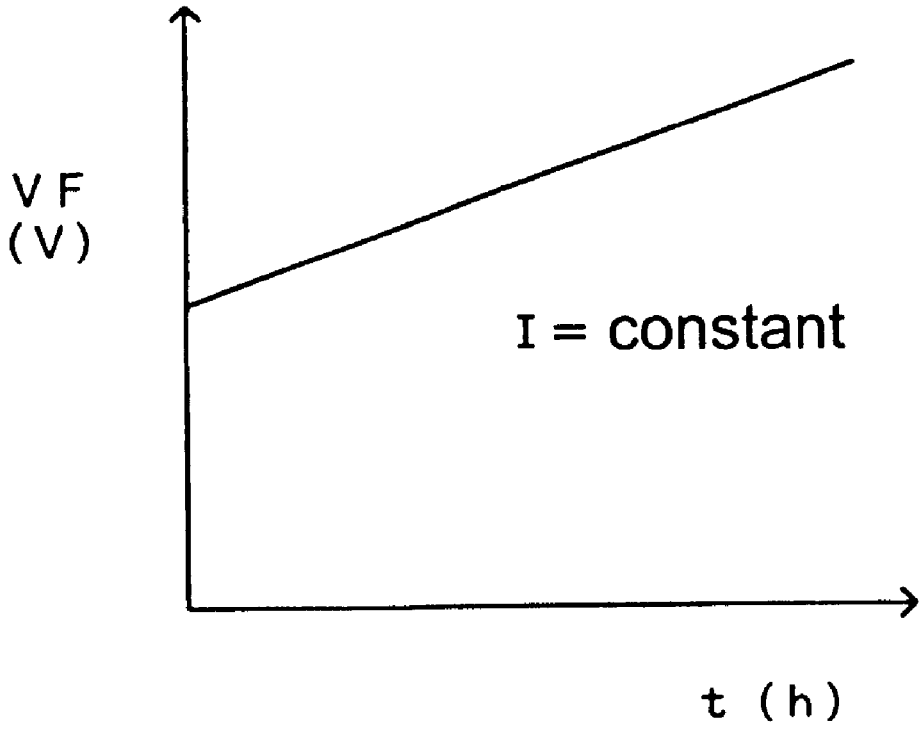
Fig. 10 prior art
FIG. 10 is a view showing the relation between the driving voltage of the conventional self-luminous display element and the elapsed time.

FIG. 7 is a view showing a schematic structure of the self-luminous display element driving circuit according to the embodiment 4 of the present invention. Incidentally, the same portions as those of FIG. 1 are designated by the same symbols and their description is omitted. In the self-luminous display element driving circuit of the embodiment 4, a deterioration information generating circuit 701 is provided instead of the deterioration information generating circuit 102 shown in FIG. 1. The deterioration information generating circuit 701 includes a not-shown constant-current driving circuit and a voltage detecting circuit.

This constant-current driving circuit makes constant-current driving of one segment of the self-luminous display element 101, and the voltage detecting circuit detects a voltage drop caused by the segment which is constant-current driven by this constant-current driving circuit. That is, the circuit detects what is the voltage needed to supply a constant current. The circuit 701 generates deterioration information on the basis of the detection result of the voltage detecting circuit.

Here, the segment which is constant-current driven by the constant-current driving circuit may always be constant-current driven, instead of being constant-voltage driven, or it may be normally constant-voltage driven and only when the deterioration information is generated, constant-current driving may be made. In the case of changing to the constant-current driving in order to generate the deterioration information, it may be automatically performed in the middle of the night by using time information of an electronic watch. Incidentally, since the constant-current driving circuit and the voltage detecting circuit are conventional techniques well known to one skilled in the art, their description is omitted.

In the foregoing structure, the operation of the embodiment 4 will be described. In accordance with a detection signal from the not-shown voltage detecting circuit, the circuit 701 generates deterioration information, for example, "1" in the case where the voltage drop is 3 V, or "2" in the case where it is 3.1 V, and outputs the deterioration information to the drive pulse width adjusting circuit 104. That is, the deterioration information generating circuit 701 directly detects the voltage needed to supply a constant current to the self-luminous display element 101 and adjusts on and off time widths of the self-luminous display element 101.

According to the foregoing embodiment 4, since the voltage drop of the self-luminous display element is directly detected to adjust a time width in which the constant voltage is applied to the self-luminous display element and a time width in which the constant voltage is not applied, the brightness of the self-luminous display element can be adjusted more accurately.

As described above, according to the present invention, in the driving device for constant-voltage driving the self-luminous display element, the self-luminous display element driving device generates the deterioration information concerning the deterioration state of the self-luminous display element, and adjust, on the basis of the deterioration information, the time width in which the constant voltage is applied to the self-luminous display element or the time width in which the constant voltage is not applied, so that it is possible to prevent the luminance of the self-luminous display element from changing with the elapse of time and to reduce the cost.

Besides, in the self-luminous display element driving device of the present invention, since the self-luminous display element is an electroluminescence element which deteriorates with the elapse of time and V-l characteristics of which are greatly changed, the prevention of luminance change becomes especially effective.

Besides, in the self-luminous display element driving device of the present invention, since the self-luminous display element is an organic electroluminescence element which deteriorates with the elapse of time and V-l characteristics of which are greatly changed, the prevention of luminance change becomes especially effective.

Besides, the self-luminous display element driving device of the present invention measures a time and generates deterioration information on the basis of the time, a clock signal for time measurement can be jointly owned with another circuit. Besides, since the time is measured and the deterioration information on the basis of the time is generated, the deterioration information can be simply generated, and the cost can be further reduced.

Besides, since the self-luminous display element driving device of the present invention detects the luminance of a part or all of the self-luminous display element and generates the deterioration information on the basis of the luminance, it is possible to more accurately prevent the luminance of the self-luminous display element from changing with the elapse of time.

Besides, since the self-luminous display element driving device of the present invention detects a current flowing through a part or all of the self-luminous display element and generates the deterioration information on the basis of the current value, it is possible to more accurately prevent the luminance of the self-luminous display element from changing with the elapse of time.

Besides, since the self-luminous display element driving device of the present invention makes constant-current driving of a part or all of the self-luminous display element, detects a voltage drop by the self-luminous display element which is constant-current driven, and generates the deterioration information on the basis of the voltage value, it is possible to more accurately prevent the luminance of the self-luminous display element from changing with the elapse of time.

What is claimed is:

1. A self-luminous display element driving device for constant-voltage driving a self-luminous display element by continuously making on and off states of application of a constant voltage to the self-luminous display element, wherein the self-luminous display element driving device comprises:

generation means for generating deterioration information concerning a deterioration state of the self-luminous display element; and adjustment means for adjusting a time width in which the constant voltage is applied to the self-luminous display element or a time width in which the constant voltage is not applied, on the basis of the deterioration information generated by the generation means.

2. A self-luminous display element driving device according to claim 1, wherein the self-luminous display element is an electroluminescence element.

3. A self-luminous display element driving device according to claim 1, wherein the self-luminous display element is an organic electroluminescence element.

4. A self-luminous display element driving device according to claim 1, wherein said generation means measures a time and generates the deterioration information on the basis of the time.

5. A self-luminous display element driving device according to claim 2, wherein said generation means measures a time and generates the deterioration information on the basis of the time.

6. A self-luminous display element driving device according to claim 3, wherein said generation means measures a time and generates the deterioration information on the basis of the time.

7. A self-luminous display element driving device according to claim 1, wherein said generation means detects luminance of a part or all of the self-luminous display element and generates the deterioration information on the basis of the luminance.

8. A self-luminous display element driving device according to claim 2, wherein said generation means detects luminance of a part or all of the self-luminous display element and generates the deterioration information on the basis of the luminance.

9. A self-luminous display element driving device according to claim 3, wherein said generation means detects luminance of a part or all of the self-luminous display element and generates the deterioration information on the basis of the luminance.

10. A self-luminous display element driving device according to claim 1, wherein said generation means detects a current flowing to a part or all of the self-luminous display element and generates the deterioration information on the basis of a current value.

11. A self-luminous display element driving device according to claim 2, wherein said generation means detects a current flowing to a part or all of the self-luminous display element and generates the deterioration information on the basis of a current value.

12. A self-luminous display element driving device according to claim 3, wherein said generation means detects a current flowing to a part or all of the self-luminous display element and generates the deterioration information on the basis of a current value.

13. A self-luminous display element driving device according to claim 1, wherein said generation means comprises constant-current driving means for constant-current driving a part or all of the self-luminous display element, and detects a voltage drop caused by the self-luminous display element, which is constant-current driven by the constant-current driving means, to generate the deterioration information on the basis of a voltage value.

14. A self-luminous display element driving device according to claim 2, wherein said generation means comprises constant-current driving means for constant-current driving a part or all of the self-luminous display element, and detects a voltage drop caused by the self-luminous display element, which is constant-current driven by the constant-current driving means, to generate the deterioration information on the basis of a voltage value.

15. A self-luminous display element driving device according to claim 3, wherein said generation means comprises constant-current driving means for constant-current driving a part or all of the self-luminous display element, and detects a voltage drop caused by the self-luminous display element, which is constant-current driven by the constant-current driving means, to generate the deterioration information on the basis of a voltage value.

* * * * *